US006162153A

United States Patent [19]

Perez, Jr. et al.

[11] Patent Number: 6,162,153

[45] Date of Patent: Dec. 19, 2000

[54] EXERCISE MACHINE WITH USER INTERFACE ELEMENT OPERABLE IN MULTIPLE DIRECTIONS AGAINST BODYWEIGHT RESISTANCE

[76] Inventors: Charles Perez, Jr., 4051 Glencoe Ave., #8; Dean G. Tornabene, 4051 Glenco Ave., #8, both of Marina Del Rey, Calif. 90292

[21] Appl. No.: 09/419,353

[22] Filed: Oct. 18, 1999

[51] Int. Cl.[7] ..... A63B 21/068; A63B 21/04; A63B 21/015

[52] U.S. Cl. ..... 482/96; 482/118; 482/130; 482/137

[58] Field of Search ..... 482/72, 95, 96, 482/112, 118, 123, 130, 135, 137, 142, 144

[56] References Cited

U.S. PATENT DOCUMENTS

| | | | |
|---|---|---|---|
| 3,380,737 | 4/1968 | Elia et al. | 482/72 |
| 4,183,520 | 1/1980 | Chase | 482/112 |
| 4,627,616 | 12/1986 | Kauffman | 482/96 |
| 4,641,833 | 2/1987 | Trethewey | 482/95 |
| 5,346,447 | 9/1994 | Stearns | 482/96 |
| 5,354,251 | 10/1994 | Sleamaker | 482/96 |
| 5,492,518 | 2/1996 | Measom | 482/96 |
| 5,527,249 | 6/1996 | Harris | 482/96 |
| 5,599,261 | 2/1997 | Easley et al. | 482/130 |
| 5,643,147 | 7/1997 | Huang | 482/72 |
| 5,830,115 | 11/1998 | Chen | 482/96 |
| 5,885,197 | 3/1999 | Barton | 482/144 |
| 5,944,641 | 8/1999 | Habing | 482/96 |

*Primary Examiner*—John Mulcahy
*Assistant Examiner*—Victor Hwang
*Attorney, Agent, or Firm*—David A. Belasco; Beehler & Pavitt

[57] ABSTRACT

A compact, portable exercise machine includes a base, a pair of receiving means, a pair of parallel support bars fitting slidably within the receiving means, a body support platform, a resistance device, a cable, pulleys, and a cable tightening means. The base has a forward end and an after end and has the first and second receiving means located between the two ends. The support bars each has a forward end and an after end and are joined at these ends by front and rear connecting bars. The platform has a forward end and an after end and is attached to the front connecting bar and the rear connecting bar. Seat, head-rest and foot rests are attached to the platform. The resistance device is removably attached at its upper end adjacent the forward end of the body support platform and removably attached at its lower end adjacent the forward end of the base. A first pulley is attached adjacent the after end of the base. The cable tightening means is attached to the support bars. The cable is attached at its first end to the rear connecting bar, passes through the first pulley, and is attached at its second end to the cable tightening means. When the cable tightening means is operated by a user in either of a first and a second direction, the after end of the body support platform is urged toward the base against the resistance device and the weight of the user.

13 Claims, 9 Drawing Sheets

EXERCISE MACHINE WITH USER INTERFACE ELEMENT OPERABLE IN MULTIPLE DIRECTIONS AGAINST BODYWEIGHT RESISTANCE

FIELD OF INVENTION

The invention pertains to devices for improving physical fitness. More particularly, the invention relates to machines that employ mechanical means to allow the user to repetitively stress his or her muscles in predetermined exercise routines to improve muscular conditioning and provide aerobic exercise.

BACKGROUND OF THE INVENTION

Various types of exercise machines have been developed to improve physical conditioning; incorporating a number of different technologies. U.S. Pat. No. 5,527,249 issued to Harris is a multi-function exercise machine utilizing the body weight of an exerciser as a resistance element for a variety of exercises for which the machine may be configured.

U.S. Pat. No. 5,885,197 issued to Barton, provides a cable operated tilting exercise platform, in which the cable is tensioned by an electric motor to provide a variety of exercise positions. U.S. Pat. No. 5,527,250, issued to Chen is a horse-riding type exercise machine combined with a stepper-type exerciser. The machine utilizes body weight as a resistance element for the horse-riding machine while the resistance elements operate to provide resistance for the stepper function. U.S. Pat. No. 5,421,796 issued to Jones et al. discloses a tricep exercise machine capable of orienting a user's body at different angles to a weight stack that is elevated by the user through a lever and cam arrangement. U.S. Pat. No. 5,695,438 issued to Bjornsti provides a tiltable exercise platform to which the user is clamped is a relatively vertical position. The user may then perform various back, neck, and shoulder twisting exercises.

While other variations exist, the above-described designs for exercise machines are typical of those encountered in the prior art. It is an objective of the present invention to provide an exercise machine that is suitable for conditioning the arms, upper body and abdomen is a variety of different exercises. It is a further objective invention to provide an exercise machine that utilizes the body's weight as a resistance element. It is another objective to provide a device that will permit arm exercises involving both pulling and pushing in the same machine with minimal adjustments. It is a still further objective of the invention to provide the above-described capabilities in an inexpensive and durable machine that is capable of extended duty cycles and that may be easily stored and transported. It is yet a further objective to provide a machine that allows for differing strength levels among users and allows the user to make the exercises more challenging as he or she develops better conditioning.

While some of the objectives of the present invention are disclosed in the prior art, none of the inventions found include all of the requirements identified.

SUMMARY OF THE INVENTION

The present invention addresses all of the deficiencies of prior art exercise inventions and satisfies all of the objectives described above. An exercise machine providing the desired features may be constructed from the following components. A base is provided that has a forward end and an after end. The base includes first and second receiving means located between the forward end and the after end. First and second parallel support bars are provided. Each of the support bars has a forward end and an after end. The support bars are sized, shaped, and located to fit slidably within one of the first and second receiving means, respectively.

Front and rear connecting bars are provided. The front connecting bar joins the first and second support bars at their forward ends and the rear connecting bar joins the first and second support bars at their after ends. A body support platform is provided. The platform has a forward end and an after end and is fixedly attached at its forward end to the front connecting bar and fixedly attached at its after end to the rear connecting bar.

A resistance device is provided. The resistance device has an upper end and a lower end. The device is removably attached at its upper end adjacent the forward end of the body support platform and removably attached at its lower end adjacent the forward end of the base. A first pulley is fixedly attached adjacent the after end of the base. A cable tightening means is fixedly attached to the first and second parallel support bars. A cable has a first end and a second end. The cable is fixedly attached at its first end to the rear connecting bar, passes through the first pulley, and is fixedly attached at its second end to the cable tightening means.

When the cable tightening means is operated by a user in either of a first and a second direction, the after end of the body support platform is urged toward the base against the resistance device and the weight of the user.

In a variant of the invention, the cable tightening means further includes first and second mounting blocks. Each of the first and second blocks have an inner side, an outer side, a lower surface, a circular orifice of a first internal diameter and a stop lug fixedly attached to the inner side and spaced from the orifice. Each of the first and second mounting blocks is fixedly attached at its lower surface to one of the first and second support bars, respectively. The mounting blocks are attached such that the orifice of the first mounting block is collinear with the orifice of the second mounting block, the inner side of the first block is parallel to the inner side of the second block, and the stop lug of the first block is located facing the stop lug of the second block.

A first rigid, tubular shaft is provided. The first tubular shaft has a first end, a second end, an internal bearing having the first internal diameter, a first predetermined length and is sized, shaped and located to fit slidably between the first and second mounting blocks. A first bearing shaft is provided. The first shaft has a first end and a second end and is sized, shaped, and located to fit slidably within the internal bearing of the first tubular shaft and to extend through the orifices of the first and second mounting blocks.

Means are provided for securing the first bearing shaft between the first and second mounting blocks. First and second travel-limiting arms are provided. Each of the first and second arms have a first end and a second end and is fixedly attached at its first end adjacent one of the first and second ends of the first tubular shaft such that a long axis of each of the arms is perpendicular to a long axis of the first tubular shaft. Each of the first and second travel-limiting arms is sized, shaped and located to limit a rotation of the first tubular shaft about the bearing shaft by engaging one of the first and second stop lugs adjacent one of the second ends of the travel-limiting arms.

A hollow support column is provided. The column has an upper end, a lower end, a front surface, a rear surface, a first side, a second side and is fixedly attached at its lower end perpendicular to the first tubular shaft between its first end and its second end. The support column includes a hollow, pulley support arm. The support arm has a first end and a second end and is fixedly attached at its first end perpendicular to the rear surface of the support column adjacent its upper end.

A second pulley is rotatably mounted adjacent the second end of the pulley support arm. The support column includes a first opening and a second opening. The first opening penetrates one of the front and rear surfaces of the column adjacent its lower end and is sized, shaped and located to permit passage of the cable. The second opening penetrates one of the front and rear surfaces of the column adjacent its lower end and is sized, shaped and located to permit the introduction of a third pulley. A third pulley is rotatably mounted within the support column between its first and second openings.

A second rigid, tubular shaft has a first end, a second end, a second internal bearing that has a second internal diameter, and a second predetermined length less than the first predetermined length and is fixedly attached perpendicular to the support column adjacent its upper end and parallel to the first tubular shaft.

A tensioning frame is provided. The tensioning frame includes first and second parallel side members, a lower cross member, first and second parallel offset members and a hollow actuating bar. Each of the side members has an upper end, a lower end, an inner side, an outer side and a circular orifice of the second internal diameter located adjacent its upper end. The orifices are collinear and the side members are spaced apart by the second predetermined length. The cross member is fixedly attached to each of the side members adjacent its lower end and has an anchoring means located between the side members.

A second bearing shaft has a first end and a second end and is sized, shaped, and located to fit slidably within the internal bearing of the second tubular shaft and to extend through the orifices of the first and second side members. Means are provided for securing the second bearing shaft between the first and second side members. The first and second offset members each have a first end and a second end. The second end includes a circular orifice sized to rotatably accommodate the actuating bar. Each offset member is fixedly attached at its first end to one of the outer sides of one of the first and second side members adjacent its upper end. The actuating bar has a first end, a second end and is rotatably mounted within the orifices of the first and second offset members. Means are provided for removably securing the actuating bar to one of the first and second side members of the tensioning frame. Means are provided for applying a twisting force to the actuating bar.

When the cable is fixedly attached at its first end to the rear connecting bar, passing under the first pulley, over the second pulley, under the third pulley, and is fixedly attached to the anchoring means of the lower cross member of the tensioning frame, the actuating bar may be twisted in either one of a clockwise and anti-clockwise direction to cause the cable to be tightened and thereby urging the after end of the body support platform toward the after end of the base against the resistance device and the weight of the user.

In a further variant of the invention the actuating bar, first and second side members and the means for removably securing the actuating bar to one of the first and second side members of the tensioning frame further include a locating plate. The locating plate has a first side, a second side, a mounting portion, a distal edge and is fixedly attached at the mounting portion adjacent one of the first and second ends of the actuating bar such that the first and second sides of the plate are orthogonal to a long axis of the bar.

The locating plate has at least one alignment hole of a third predetermined diameter and extends from the first side to the second side of the plate. The hole is located adjacent the distal edge at a third predetermined distance from the long axis of the bar. A securing hole is provided. The securing hole is of the third predetermined diameter and penetrates the outer side of one of the first and second side members at the third predetermined distance from the long axis of the bar.

A spring-loaded pin assembly is provided. The pin assembly includes a hollow pin housing, a pin, a means for retracting the pin and a spring urging the pin outwardly from the housing. The pin is sized and shaped to slidably engage the alignment hole in the locating plate and the securing hole in one of the first and second side members. A mounting bracket is fixedly attached to one of the first and second side members and the hollow pin housing. The mounting bracket is sized, shaped and located to position the pin to engage the securing hole and the alignment hole. The bracket is spaced from one of the first and second side members to permit the locating plate to fit slidably between the hollow pin housing and one of the first and second side members.

When the pin is urged toward the locating plate by the spring and passes through the alignment hole and into the securing hole in one of the first and second side members, the actuating bar will be removably secured to one of the first and second side members and thus the tensioning frame. This engagement permits twisting force to be applied through the actuating bar to the tensioning frame to tighten the cable and thus urge the body support platform toward the after end of the base against the resistance device and the weight of the user.

In still a further variant, the cable tightening means further includes first and second operating handles and means for removably attaching the first and second operating handles to one of the first and second ends of the actuating bar.

In another variant of the invention, the means for removably attaching the first and second operating handles to one of the first and second ends of the actuating bar further includes at least two locating notches. The notches are located at the first and second ends of the actuating bar. At least two first locking holes are provided. The first holes are spaced inwardly from the first and second ends of the actuating bar and penetrate the bar perpendicular to its long axis.

The first and second operating handles have a first end, a first portion adjacent the first end, a second end, a second portion adjacent the second end. The second portion extends from the first portion at a right angle. The operating handles are formed of rigid cylindrical material and are sized and shaped to allow the first end to fit slidably within the hollow actuating bar.

At least two first locking buttons are provided. The first buttons are located adjacent the first end of the first and second operating handles and are sized and shaped to removably engage the first locking holes in the actuating bar. At least two locating lugs are located adjacent the first end of the first and second operating handles. The lugs are sized and shaped to removably engage the locating notches located at the first and second ends of the actuating bar when the first locking buttons engage the first locking holes.

In yet another variant, the first and second operating handles further include at least two second locking buttons. The second buttons are located adjacent the second end of the first and second operating handles. First and second handle extensions are provided. The extensions have a first end, a first section adjacent the first end, a second end, a second section adjacent the second end, the second section extends from the first section at a right angle. The handle extensions are formed of hollow rigid cylindrical material and are sized and shaped to allow the second ends of the first and second operating handles to fit slidably within the first section of the handle extensions. The first section includes a plurality of second locking holes. The second locking holes are spaced from the first ends of the first and second handle extensions and are sized and shaped to removably engage the second locking buttons of the first and second operating handles. This engagement permits the first and second handle extensions to be removably secured to the second ends of the first and second operating handles in at least one position.

In yet a further variant of the invention, the first and second handle extensions further include a resilient padding material disposed upon the second section of the handle extensions. In still another variant, the body support platform further includes a seat member, a back support member and a foot support member.

In still a further variant of the invention, the resistance device further includes at least one resilient member that has a first end and a second end. A lower mounting bracket is provided that has a first end, a second end and is fixedly attached at its first end to the base adjacent its forward end. The lower mounting bracket includes means for removably attaching the lower bracket to the first end of the resilient member. The means is located adjacent the second end of the lower bracket.

An upper mounting bracket is provided that has an upper end, a lower end and is fixedly attached at its upper end to the body support platform. Means are provided for removably and adjustably attaching the second end of the resilient member to the lower end of the upper mounting bracket.

In yet another variant, the means for removably and adjustably attaching the second end of the resilient member to the lower end of the upper mounting bracket further includes an offset bar. The offset bar has a first end, a second end and a top surface. The offset bar has a means fixedly attached adjacent its first end for removably attaching to the second end of the resilient member. The offset bar is pivotally mounted adjacent its second end to the lower end of the upper mounting bracket. An actuating handle is provided that has a first end, an elongated body, a second end and is pivotally mounted to the top surface of the offset bar adjacent its second end. A plurality of adjusting notches are affixed to the body support platform adjacent the upper mounting bracket. The notches are sized, shaped, and located to removably engage the elongated body of the actuating handle.

When the actuating handle is pivoted in a first direction it will be disengaged from one of the adjusting notches and when the actuating handle is pressed toward the forward end of the base, the offset bar will pivot at the lower end of the upper mounting bracket and thereby impart tension to the resilient member. When the elongated body is aligned with another adjusting notch and the actuating handle is pivoted in a second direction the elongated body will engage the notch. The resilient member will retain the imparted tension and the actuating handle may be released, thereby increasing the effort required to operate the exercise machine.

In still another variant of the invention, the resistance device further includes at least one adjustable shock absorber that has a first end and a second end. The shock absorber is removably attached at its first end to the base adjacent its forward end and is removably attached at its second end to the body support platform adjacent its forward end.

In yet a further variant, the resistance device further includes an adjustable friction clutch assembly. The clutch assembly includes a driven plate member, a friction disk member, means for rotatably mounting the friction disk member to the driven plate member and a means for tightening the disk member against the driven plate member. A first mounting arm is provided that has a first end, a second end and is fixedly attached at its first end to the driven plate member and removably attached at its second end to the body support platform adjacent its forward end. A second mounting arm is provided that has a first end, a second end and is fixedly attached at its first end to the friction disk member and removably attached at its second end to the base adjacent its forward end. When the disk member is tightened against the driven plate member using the means for the tightening, the effort to operate the exercise machine will be increased.

In a final variant of the invention, the first and second parallel support bars are each formed of two removably joinable portions, the rear connecting bar is readily detachable from the support bars at after their ends, and the body support platform is formed of two removably joinable portions, thereby facilitating transport and storage of the machine.

DETAILED DESCRIPTION OF THE PREFERRED EMBODIMENTS

Figure 1:
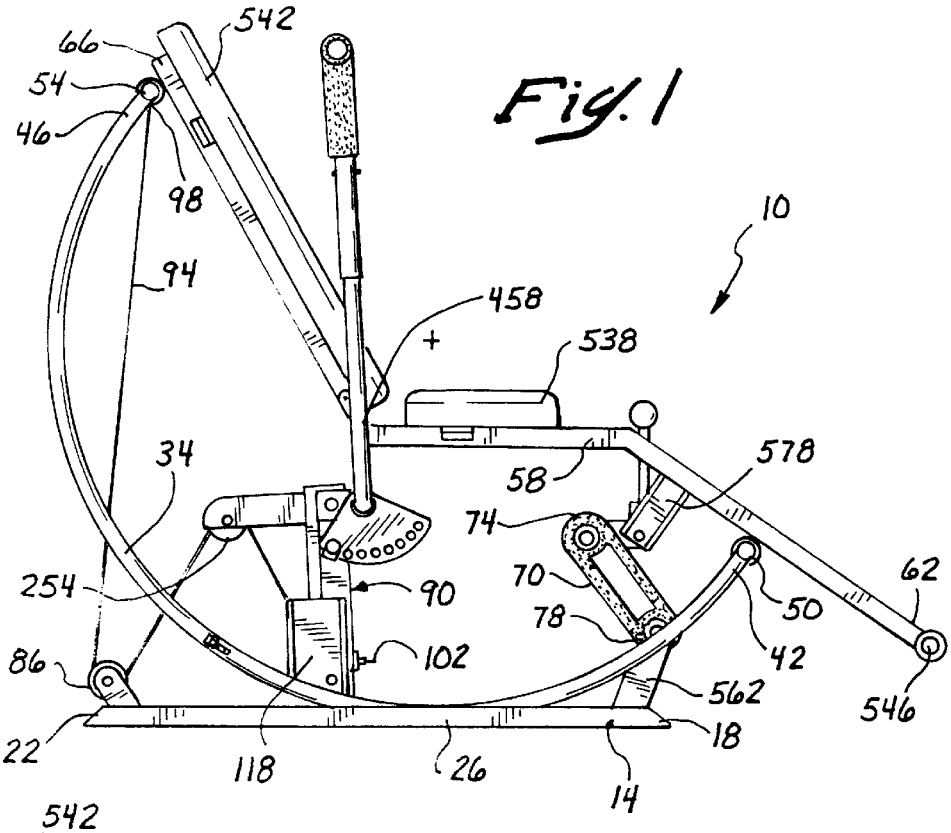
FIG. 1 is a left side elevation of the preferred embodiment of the invention with the actuating handles in an upright position.

As illustrated in FIGS. 1–8, an exercise machine 10 providing the desired features may be constructed from the following components. A base 14 is provided that has a forward end 18 and an after end 22. The base 14 includes first 26 and second 30 receiving means located between the forward end 18 and the after end 22. First 34 and second 38 parallel support bars are provided. Each of the support bars 34, 38 has a forward end 42 and an after end 46. The support bars 34, 38 are sized, shaped, and located to fit slidably within one of the first 26 and second 30 receiving means, respectively.

Front 50 and rear 54 connecting bars are provided. The front connecting bar 50 joins the first 34 and second 38 support bars at their forward ends 42 and the rear connecting bar 54 joins the first 34 and second 38 support bars at their after ends 22. A body support platform 58 is provided. The platform 58 has a forward 62 end and an after end 66 and is fixedly attached at its forward 62 end to the front connecting bar 50 and fixedly attached at its after end 66 to the rear connecting bar 54.

A resistance device 70 is provided. The resistance device 70 has an upper end 74 and a lower end 78. The device 70 is removably attached at its upper end 74 adjacent the forward end 62 of the body support platform 58 and removably attached at its lower end 78 adjacent the forward end 18 of the base 14. A first pulley 86 is fixedly attached adjacent the after end 22 of the base. A cable tightening means 90 is fixedly attached to the first 34 and second 38 parallel support bars. A cable 94 has a first end 98 and a second end 102. The cable 94 is fixedly attached at its first end 98 to the rear connecting bar 54, passes through the first pulley 86, and is fixedly attached at its second end 102 to the cable tightening means 90.

Figure 1A:
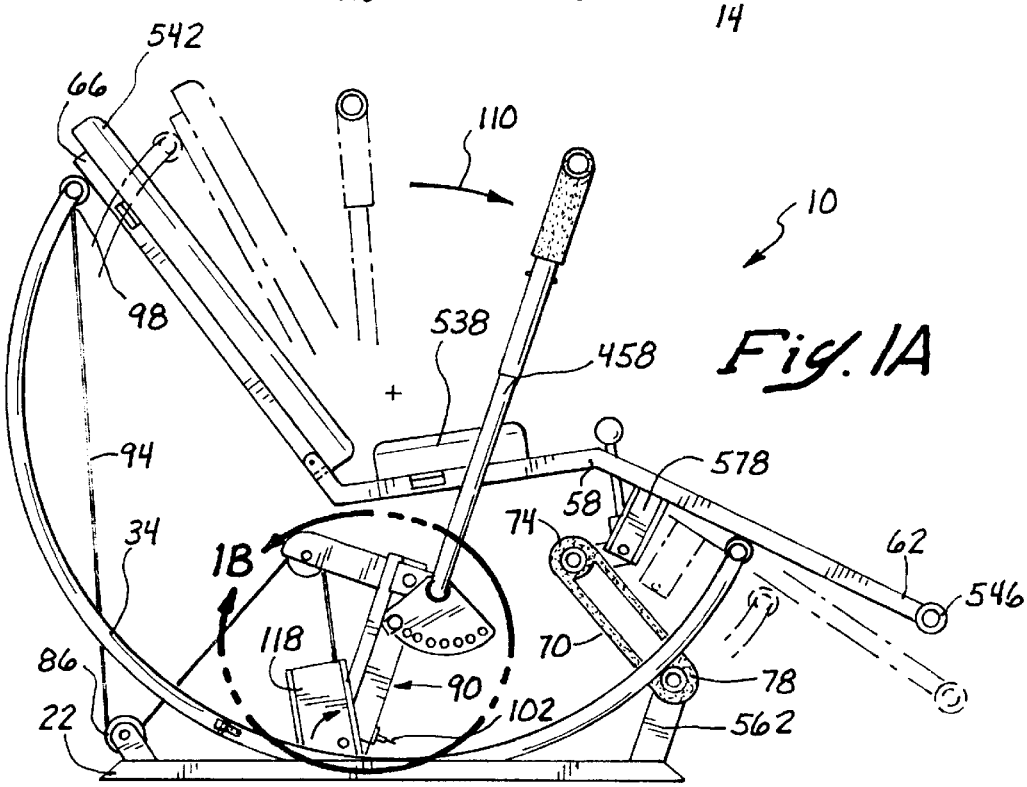
FIG. 1*a* is a left side elevation of the FIG. 1 embodiment illustrating rotation of the exercise machine due to forward pressure on the actuating handles.
Figure 2B:
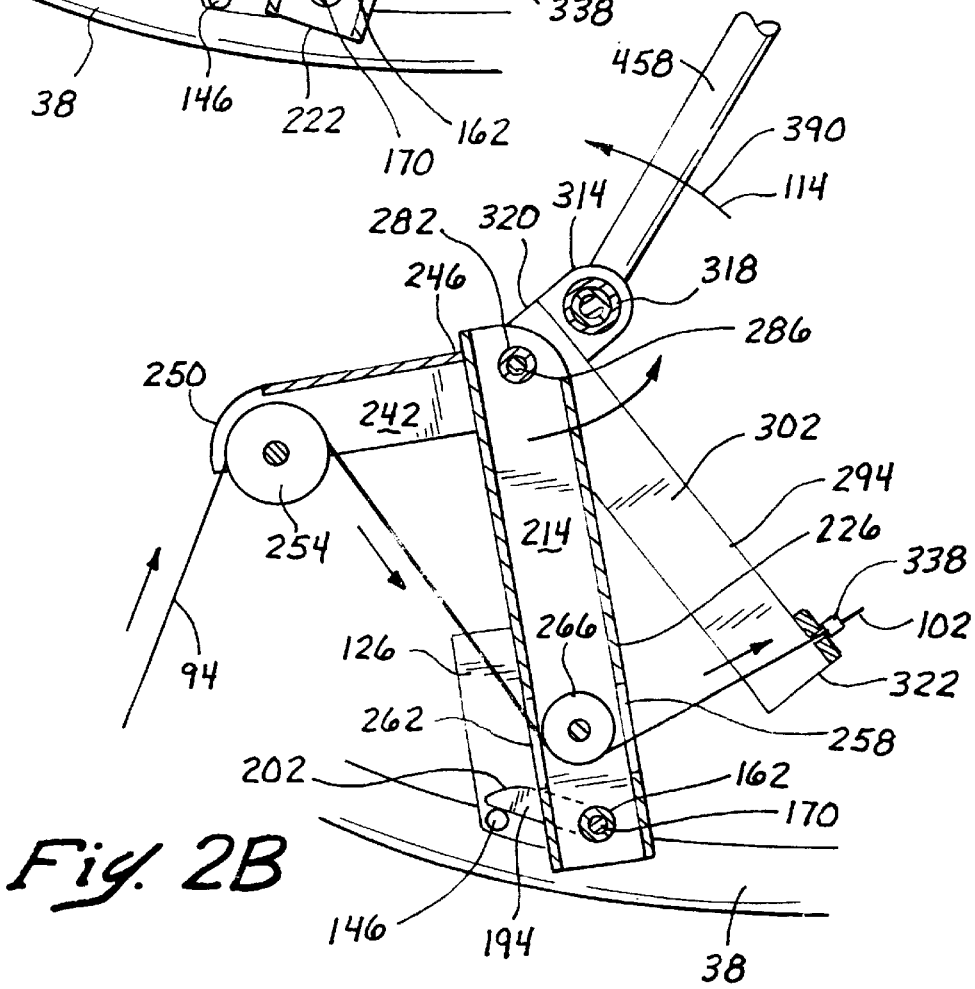
FIG. 2*b* is a sectional view of the cable tightening means indicated by line 2B—2B in FIG. 2*a,* operated in a second direction.
Figure 2:
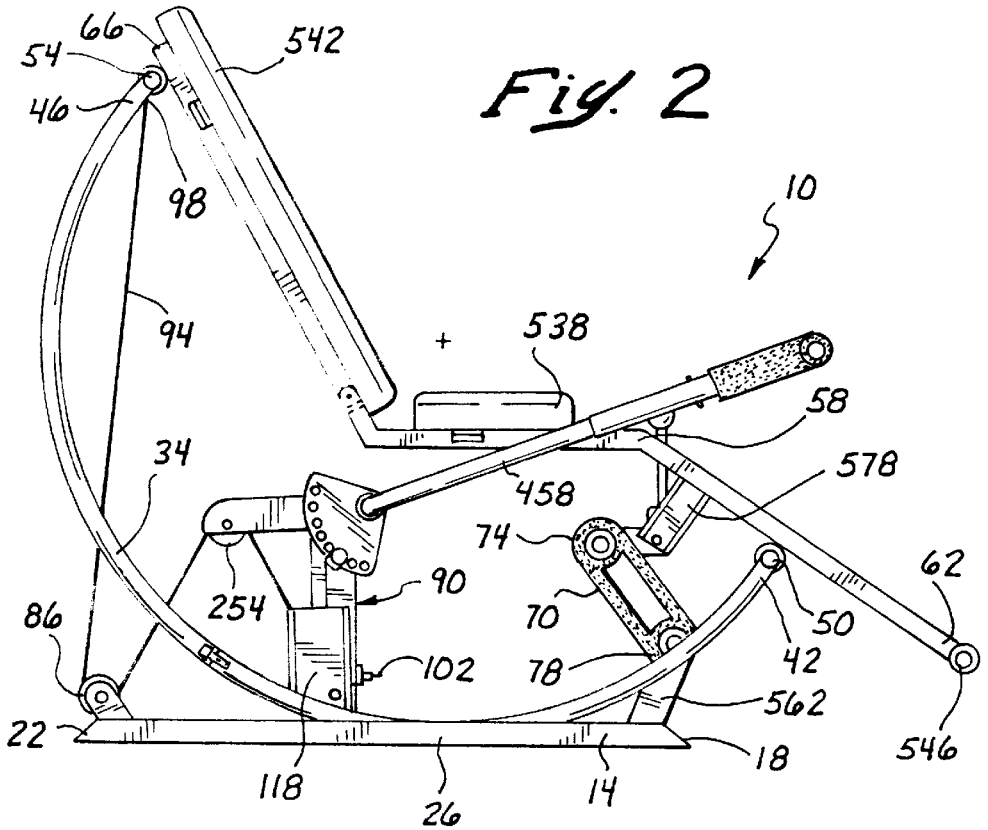
FIG. 2 is a left side elevation of the FIG. 1 embodiment with the actuating handles in a forward position.
Figure 2A:
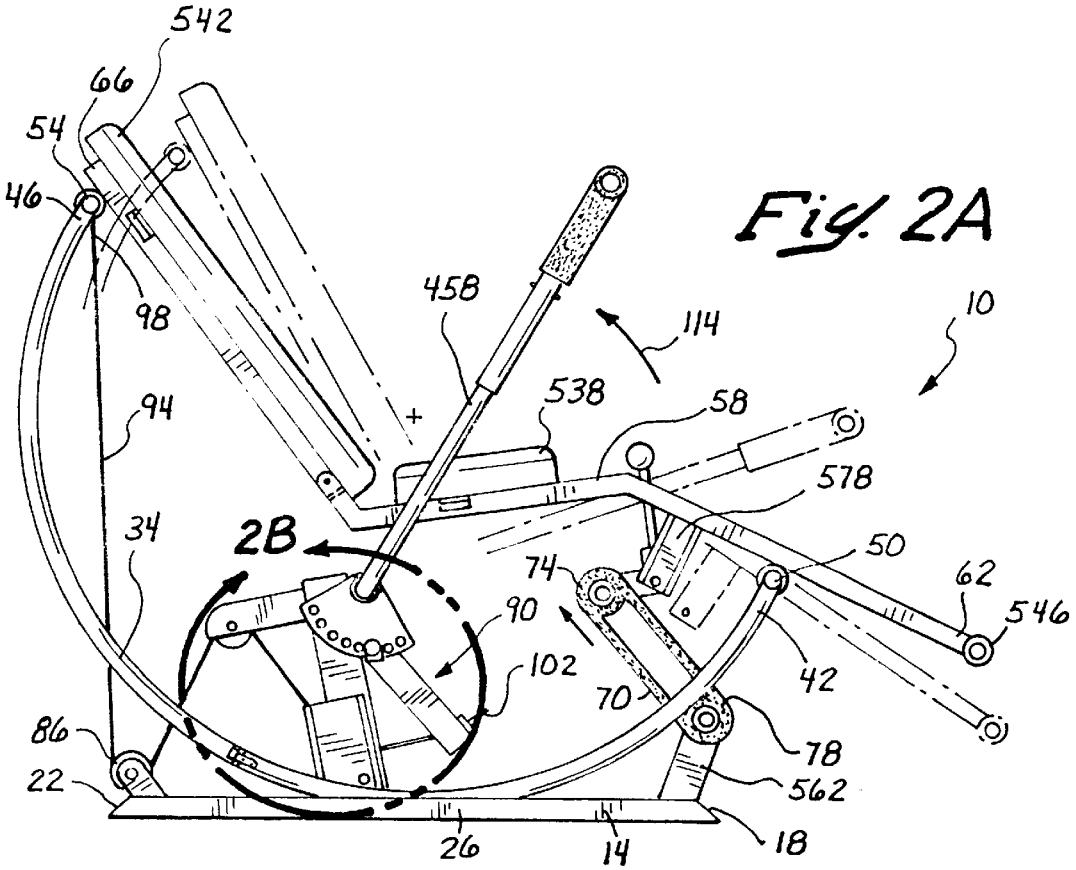
FIG. 2*a* is a left side elevation of the FIG. 1 embodiment illustrating rotation of the exercise machine due to rearward pressure on the actuating handles.

As illustrated in FIGS. 1*a* and 2*a,* when the cable tightening means 90 is operated by a user in either of a first 110 and a second 114 direction, the after end 66 of the body support platform 58 is urged toward the base 14 against the resistance device 70 and the weight of the user.

Figure 1B:
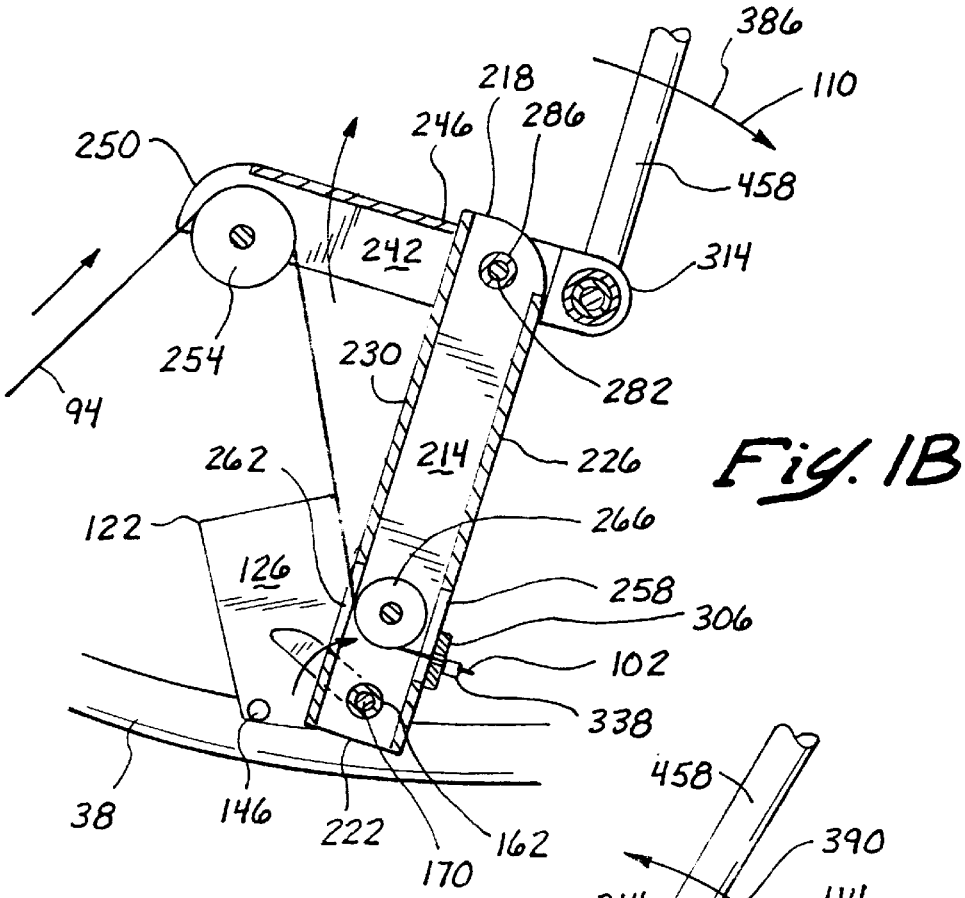
FIG. 1*b* is a sectional view of the cable tightening means indicated by line 1B—1B in FIG. 1*a,* operated in a first direction.

In a variant of the invention, as illustrated in FIGS. 1*b,* 2*b,* and 3, the cable tightening means 90 further includes first 118 and second 122 mounting blocks. Each of the first 118 and second 122 blocks have an inner side 126, an outer side 130, a lower surface 134, a circular orifice 138 of a first internal diameter 142 and a stop lug 146 fixedly attached to the inner side 126 and spaced from the orifice 138. Each of the first 118 and second 122 mounting blocks is fixedly attached at its lower surface 134 to one of the first 34 and second 38 support bars, respectively. The mounting blocks 118, 122 are attached such that the orifice 138 of the first mounting block 118 is collinear with the orifice 138 of the second mounting block 122, the inner side 126 of the first block 118 is parallel to the inner side 126 of the second block 122, and the stop lug 146 of the first block 118 is located facing the stop lug 146 of the second block 122.

A first rigid, tubular shaft 150 is provided. The first tubular shaft 150 has a first end 154, a second end 158, an internal bearing 162 having the first internal diameter 142, a first predetermined length 166 and is sized, shaped and located to fit slidably between the first 118 and second 122 mounting blocks. A first bearing shaft 170 is provided. The first shaft 170 has a first end (not shown) and a second end 178 and is sized, shaped, and located to fit slidably within the internal bearing 162 of the first tubular shaft 150 and to extend through the orifices 138 of the first 118 and second 122 mounting blocks.

Means (not shown) are provided for securing the first bearing shaft 170 between the first 118 and second 122 mounting blocks. First 190 and second 194 travel-limiting arms are provided. Each of the first 190 and second 194 arms have a first end 198 and a second end 202 and is fixedly attached at its first end 198 adjacent one of the first 154 and second 158 ends of the first tubular shaft 150 such that a long axis 206 of each of the arms 190, 194 is perpendicular to a long axis 210 of the first tubular shaft 150. Each of the first 190 and second 194 travel-limiting arms is sized, shaped and located to limit a rotation of the first tubular shaft 150 about the bearing shaft 170 by engaging one of the first and second stop lugs 146 adjacent one of the second ends 202 of the travel-limiting arms 190, 194.

A hollow support column 214 is provided. The column 214 has an upper end 218, a lower end 222, a front surface 226, a rear surface 230, a first side (not shown), a second side 238 and is fixedly attached at its lower end 222 perpendicular to the first tubular shaft 150 between its first end 154 and its second end 158. The support column 214 includes a hollow, pulley support arm 242. The support arm 242 has a first end 246 and a second end 250 and is fixedly attached at its first end 246 perpendicular to the rear surface 230 of the support column 214 adjacent its upper end 218.

A second pulley 254 is rotatably mounted adjacent the second end 250 of the pulley support arm 242. The support column 214 includes a first opening 258 and a second opening 262. The first opening 258 penetrates one of the front 226 and rear 230 surfaces of the column 214 adjacent its lower end 222 and is sized, shaped and located to permit passage of the cable 94. The second opening 262 penetrates one of the front 226 and rear 230 surfaces of the column 214 adjacent its lower end 222 and is sized, shaped and located to permit the introduction of a third pulley 266. A third pulley 266 is rotatably mounted within the support column 214 between its first 258 and second 262 openings.

A second rigid, tubular shaft 270 has a first end 274, a second end 278, a second internal bearing 282 that has a second internal diameter 286, and a second predetermined length 290 less than the first predetermined length 166 and is fixedly attached perpendicular to the support column 214 adjacent its upper end 218 and parallel to the first tubular shaft 150.

A tensioning frame 294 is provided. The tensioning frame 294 includes first 298 and second 302 parallel side members, a lower cross member 306, first 310 and second 314 parallel offset members and a hollow actuating bar 318. Each of the side members 298, 302 has an upper end 320, a lower end 322, an inner side 326, an outer side 330 and a circular orifice 334 of the second internal diameter 286 located adjacent its upper end 320. The orifices 334 are collinear and the side members 298, 302 are spaced apart by the second predetermined length 290. The cross member 306 is fixedly attached to each of the side members 298, 302 adjacent its lower end 322 and has an anchoring means 338 located between the side members 298, 302.

Figure 5:
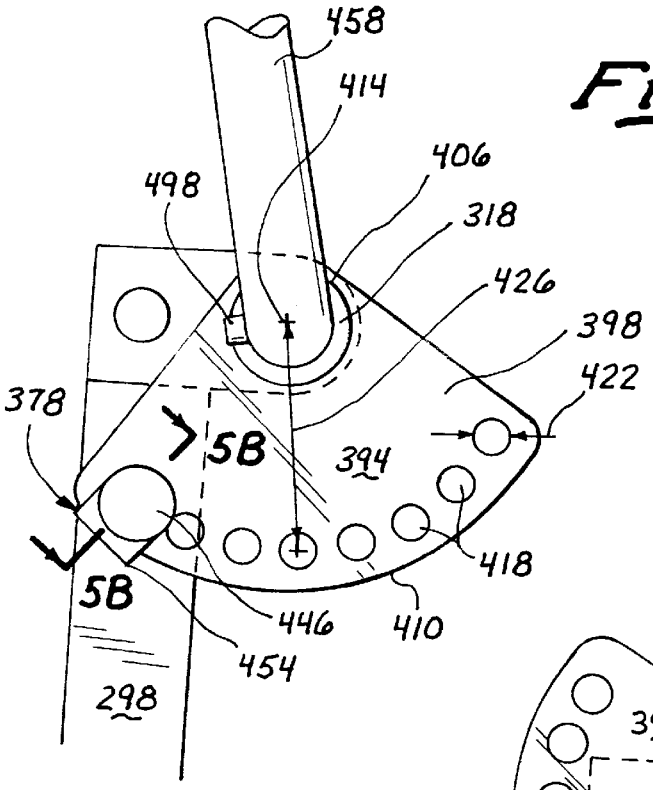
FIG. 5 is a side elevational detail of the locating plate, an actuating handle and side member with the actuating handle in an upright position.
Figure 5A:
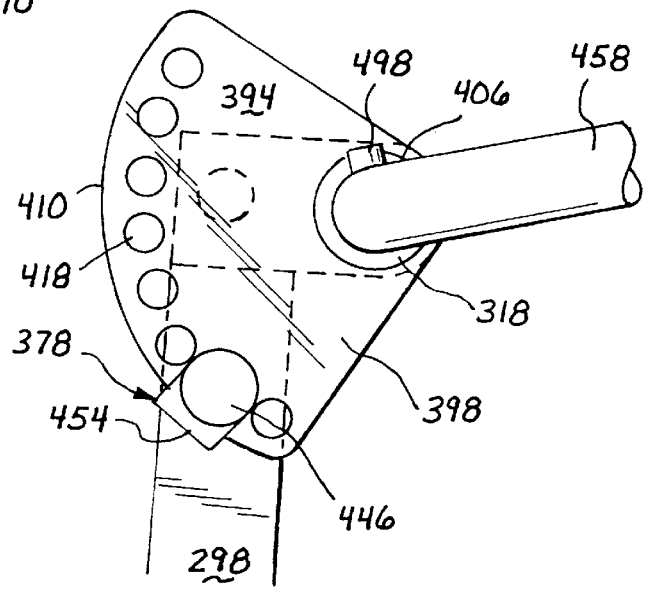
FIG. 5*a* is a side elevational detail of the locating plate, an actuating handle and side member with the actuating handle in a forward position.
Figure 5B:
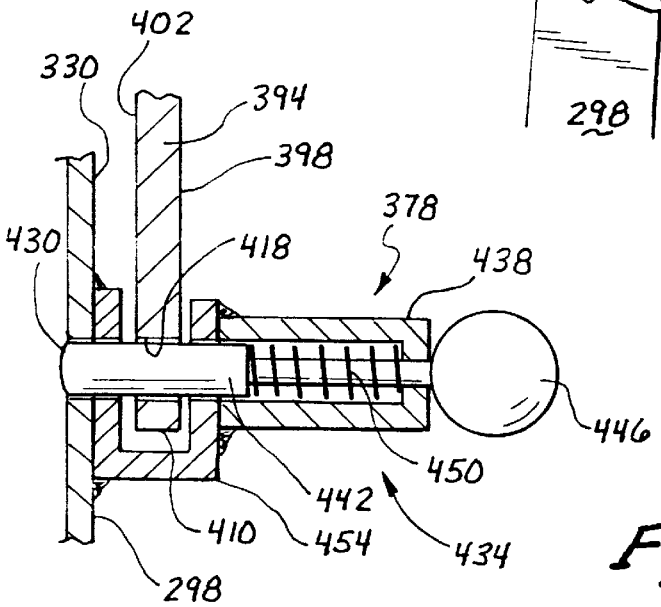
FIG. 5*b* is a cross-sectional side view of the locating plate, spring-loaded pin assembly and side member.

A second bearing shaft 342 has a first end (not shown) and a second end 350 and is sized, shaped, and located to fit slidably within the internal bearing 282 of the second tubular shaft 270 and to extend through the orifices 334 of the first 298 and second 302 side members. Means (not shown) are provided for securing the second bearing shaft 342 between the first 298 and second 302 side members. The first 310 and second 314 offset members each have a first end 366 and a second end 370. The second end 370 includes a circular orifice 374 sized to rotatably accommodate the actuating bar 318. Each offset member 310, 314 is fixedly attached at its first end 366 to one of the outer sides 330 of one of the first 298 and second 302 side members adjacent its upper end 320. The actuating bar 318 has a first end 324, a second end 328 and is rotatably mounted within the orifices 374 of the first 310 and second 314 offset members. As illustrated in FIG. 5, 5*a* and 5*b,* means 378 are provided for removably securing the actuating bar 318 to one of the first 298 and second 302 side members of the tensioning frame 294. Means 382 are provided for applying a twisting force to the actuating bar 318.

When the cable 94 is fixedly attached at its first end 98 to the rear connecting bar 54, passing under the first pulley 86, over the second pulley 254, under the third pulley 266, and is fixedly attached to the anchoring means 338 of the lower cross member 306 of the tensioning frame 294, the actuating bar 318 may be twisted in either one of a clockwise 386 and anticlockwise 390 direction to cause the cable 94 to be tightened and thereby urging the after end 66 of the body support platform 58 toward the after end 22 of the base 14 against the resistance device 70 and the weight of the user 106.

In a further variant of the invention the actuating bar 318, first 298 and second 302 side members and the means for removably securing the actuating bar 318 to one of the first 298 and second 302 side members of the tensioning frame 294 further include a locating plate 394. The locating plate 394 has a first side 398, a second side 402, a mounting portion 406, a distal edge 410 and is fixedly attached at the mounting portion 406 adjacent one of the first 324 and second 328 ends of the actuating bar 318 such that the first 398 and second 402 sides of the plate 394 are orthogonal to a long axis 414 of the bar 318.

The locating plate 394 has at least one alignment hole 418 of a third predetermined diameter 422 and extends from the first side 398 to the second side 402 of the plate 394. The hole 418 is located adjacent the distal edge 410 at a third predetermined distance 426 from the long axis 414 of the bar 318. A securing hole 430 is provided. The securing hole 430 is of the third predetermined diameter 422 and penetrates the outer side 330 of one of the first 298 and second 302 side members at the third predetermined distance 426 from the long axis 414 of the bar 318.

A spring-loaded pin assembly 434 is provided. The pin assembly 434 includes a hollow pin housing 438, a pin 442, a means 446 for retracting the pin 442 and a spring 450 urging the pin 442 outwardly from the housing 438. The pin 442 is sized and shaped to slidably engage the alignment hole 418 in the locating plate 394 and the securing hole 430 in one of the first 298 and second 302 side members. A mounting bracket 454 is fixedly attached to one of the first 298 and second 302 side members and the hollow pin housing 438. The mounting bracket 454 is sized, shaped and located to position the pin 442 to engage the securing hole 430 and the alignment hole 418. The bracket 454 is spaced from one of the first 298 and second 302 side members to permit the locating plate 394 to fit slidably between the hollow pin housing 438 and one of the first 298 and second 302 side members.

When the pin 442 is urged toward the locating plate 394 by the spring 450 and passes through the alignment hole 418 and into the securing hole 430 in one of the first 298 and second 302 side members, the actuating bar 318 will be removably secured to one of the first 298 and second 302 side members and thus the tensioning frame 294. This engagement permits twisting force to be applied through the actuating bar 318 to the tensioning frame 294 to tighten the cable 90 and thus urge the body support platform 58 toward the after end 22 of the base 14 against the resistance device 70 and the weight of the user.

Figure 3:
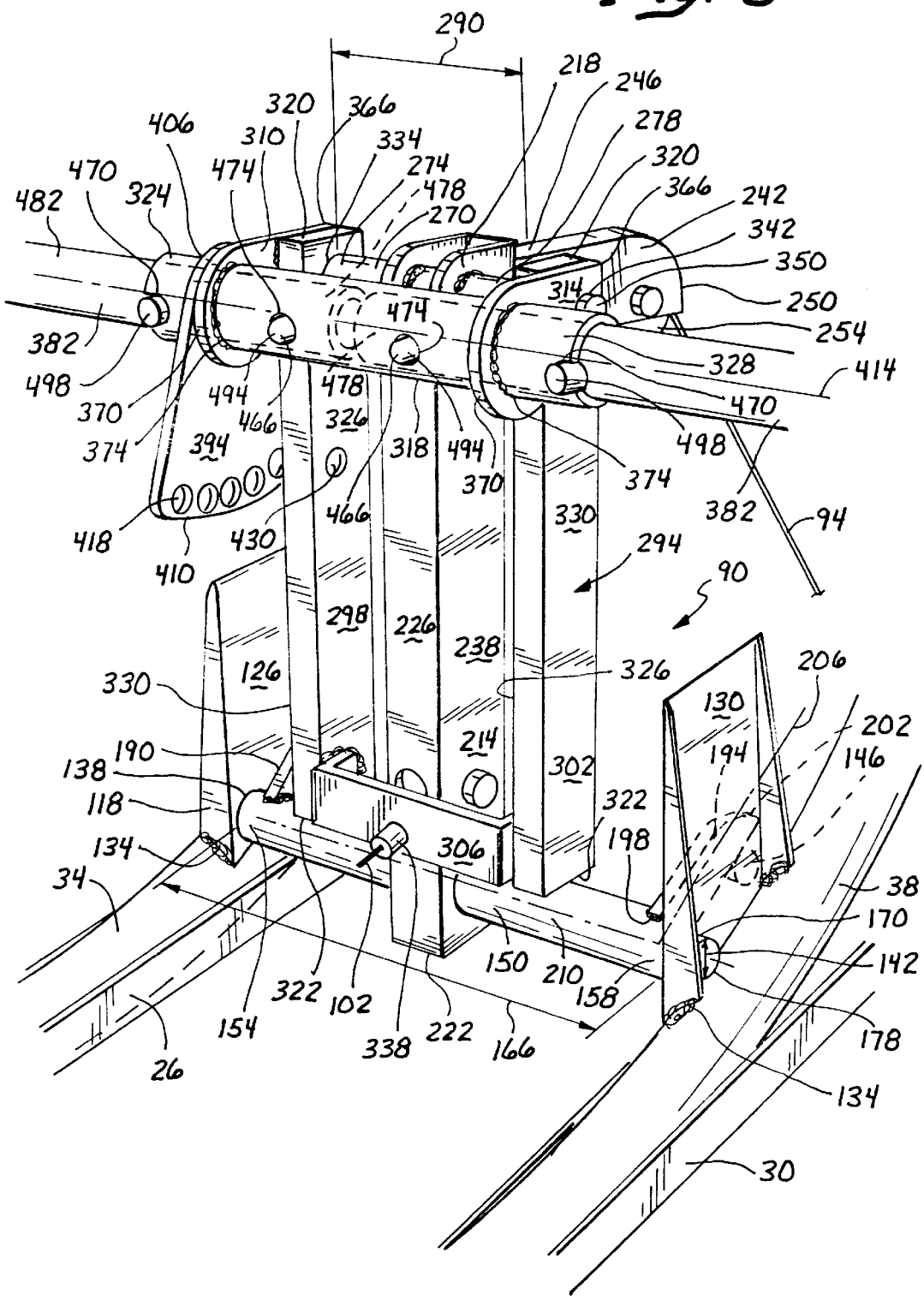
FIG. 3 is a perspective enlarged detail view of the cable tightening system of the FIG. 1 embodiment.
Figure 4:
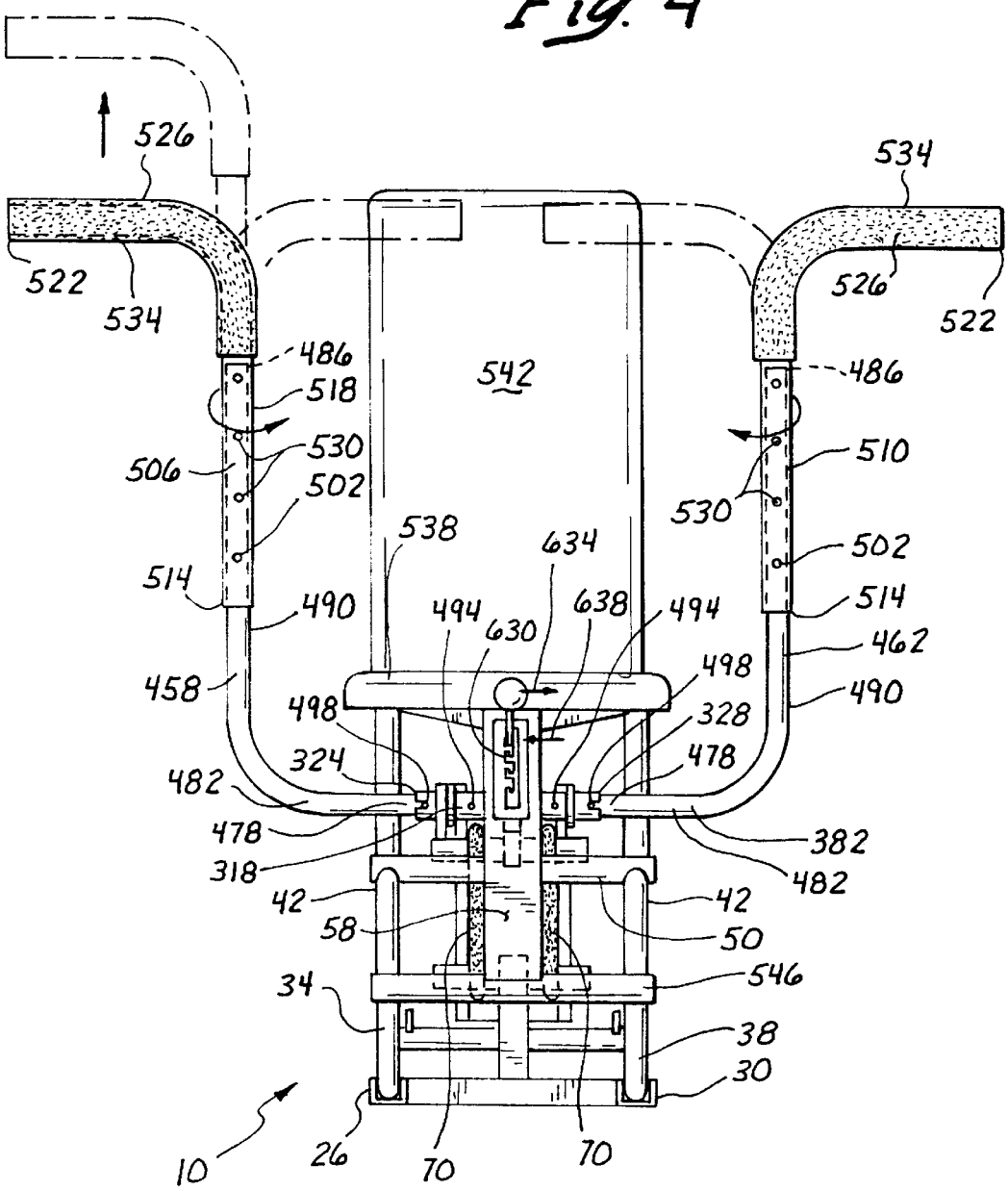
FIG. 4 is a front elevational view of the FIG. 1 embodiment.

In still a further variant, as illustrated in FIGS. 3 and 4, the cable tightening means 90 further includes first 458 and second 462 operating handles and means 466 for removably attaching the first 458 and second 462 operating handles to one of the first 324 and second 328 ends of the actuating bar 318.

In another variant of the invention, the means 466 for removably attaching the first 458 and second 462 operating handles to one of the first 324 and second 328 ends of the actuating bar 318 further includes at least two locating notches 470. The notches 470 are located at the first 324 and second 328 ends of the actuating bar 318. The actuating bar 318 has a long axis 414. At least two first locking holes 474 are provided. The first holes 474 are spaced inwardly from the first 324 and second 328 ends of the actuating bar 318 and penetrate the bar 318 perpendicular to its long axis 414.

The first 458 and second 462 operating handles have a first end 478, a first portion 482 adjacent the first end 478, a second end 486, a second portion 490 adjacent the second end 486. The second portion 490 extends from the first portion 482 at a right angle. The operating handles 458, 462 are formed of rigid cylindrical material and are sized and shaped to allow the first 478 ends to fit slidably within the hollow actuating bar 318.

At least two first locking buttons 494 are provided. The first buttons 494 are located adjacent the first end 478 of the first 458 and second 462 operating handles and are sized and shaped to removably engage the first locking holes 474 in the actuating bar 318. At least two locating lugs 498 are located adjacent the first end 478 of the first 458 and second 462 operating handles. The lugs 498 are sized and shaped to removably engage the locating notches 470 located at the first 324 and second 328 ends of the actuating bar 318 when the first locking buttons 494 engage the first locking holes 474.

In yet another variant, as illustrated in FIG. 4, the first 458 and second 462 operating handles further include at least two second locking buttons 502. The second buttons 502 are located adjacent the second end 486 of the first 458 and second 462 operating handles. First 506 and second 510 handle extensions are provided. The extensions 506, 510 have a first end 514, a first section 518 adjacent the first end 514, a second end 522, a second section 526 adjacent the second end 522, the second section 526 extends from the first section 518 at a right angle. The handle extensions 506, 510 are formed of hollow rigid cylindrical material and are sized and shaped to allow the second ends 486 of the first 458 and second 462 operating handles to fit slidably within the first section 518 of the handle extensions 506, 510. The first section 518 includes a plurality of second locking holes 530. The second locking holes 530 are spaced from the first ends 514 of the first 506 and second 510 handle extensions and are sized and shaped to removably engage the second locking buttons 502 of the first 458 and second 462 operating handles. This engagement permits the first 506 and second 510 handle extensions to be removably secured to the second ends 486 of the first 458 and second 462 operating handles in at least one position.

In yet a further variant of the invention, the first 506 and second 510 handle extensions further include a resilient padding material 534 disposed upon the second section 526 of the handle extensions 506, 510. In still another variant, illustrated in FIGS. 1 and 2, the body support platform 58 further includes a seat member 538, a back support member 542 and a foot support member 546.

Figure 6:
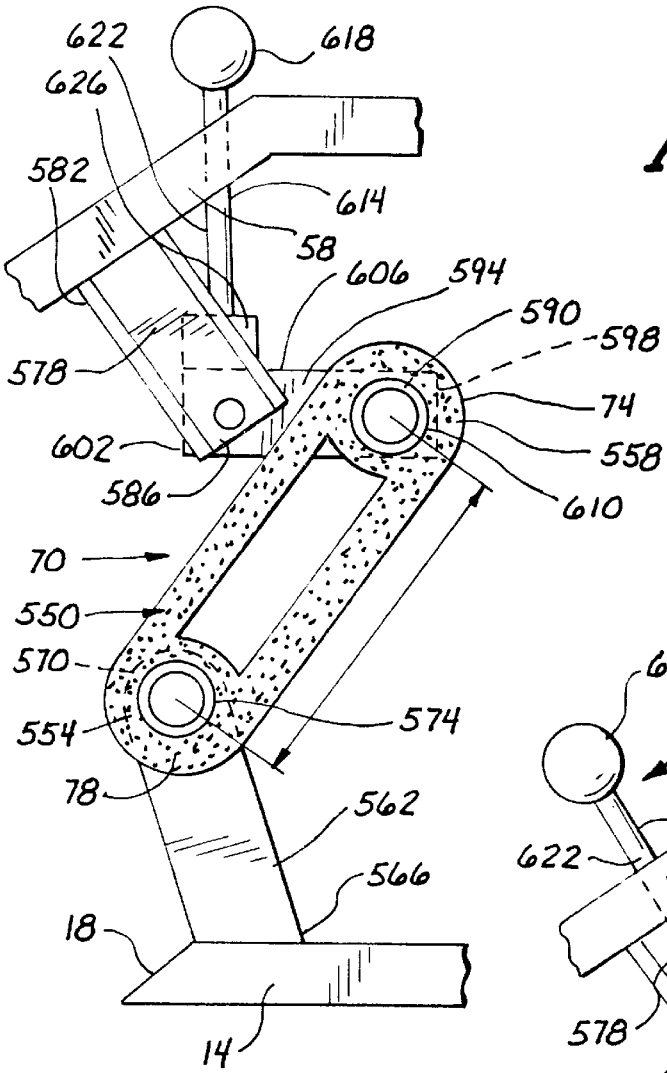
FIG. 6 is an enlarged side elevational detail of the tensioning mechanism of the FIG. 1 embodiment with the resilient member in a relaxed position.
Figure 6A:
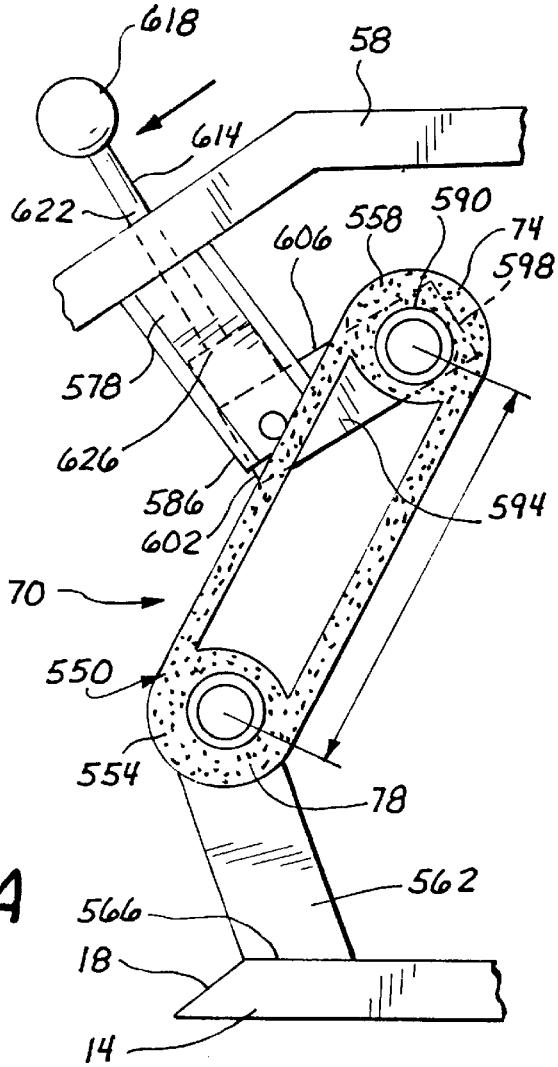
FIG. 6*a* is an enlarged side elevational detail of the tensioning mechanism of the FIG. 1 embodiment with the resilient member in an extended position.

In still a further variant of the invention, as illustrated in FIGS. 6 and 6*a,* the resistance device 70 further includes at least one resilient member 550 that has a first end 554 and a second end 558. A lower mounting bracket 562 is provided that has a first end 566, a second end 570 and is fixedly attached at its first end 566 to the base 14 adjacent its forward end 18. The lower mounting bracket 562 includes means 574 for removably attaching the lower bracket 562 to the first end 554 of the resilient member 550. The means 574 is located adjacent the second end 570 of the lower bracket 562.

An upper mounting bracket 578 is provided that has an upper end 582, a lower end 586 and is fixedly attached at its upper end 582 to the body support platform 58. Means 590 are provided for removably and adjustably attaching the second end 558 of the resilient member 550 to the lower end 586 of the upper mounting bracket 578.

In yet another variant, also illustrated in FIGS. 6 and 6*a,* the means 590 for removably and adjustably attaching the second end 558 of the resilient member 550 to the lower end 586 of the upper mounting bracket 578 further includes an offset bar 594. The offset bar 594 has a first end 598, a second end 602 and a top surface 606. The offset bar 594 has a means 610 fixedly attached adjacent its first end 598 for removably attaching to the second end 558 of the resilient member 550. The offset bar 594 is pivotally mounted adjacent its second end 602 to the lower end 586 of the upper mounting bracket 578. An actuating handle 614 is provided that has a first end 618, an elongated body 622, a second end 626 and is mounted to the top surface 606 of the offset bar 594 adjacent its second end 602. As illustrated in FIG. 4, a plurality of adjusting notches 630 are affixed to the body support platform 58 adjacent the upper mounting bracket 578. The notches 630 are sized, shaped, and located to removably engage the elongated body 622 of the actuating handle 614.

When the actuating handle 614 is pivoted in a first direction 634 it will be disengaged from one of the adjusting notches 630 and when the actuating handle 614 is pressed toward the forward end 18 of the base 14, the offset bar 594 will pivot at the lower end 586 of the upper mounting bracket 578 and thereby impart tension to the resilient member 550. When the elongated body 622 is aligned with another adjusting notch 630 and the actuating handle 614 is pivoted in a second direction 638 the elongated body 622 will engage the notch 630. The resilient member 550 will retain the imparted tension and the actuating handle 614 may be released, thereby increasing the effort required to operate the exercise machine 10.

Figure 6B:
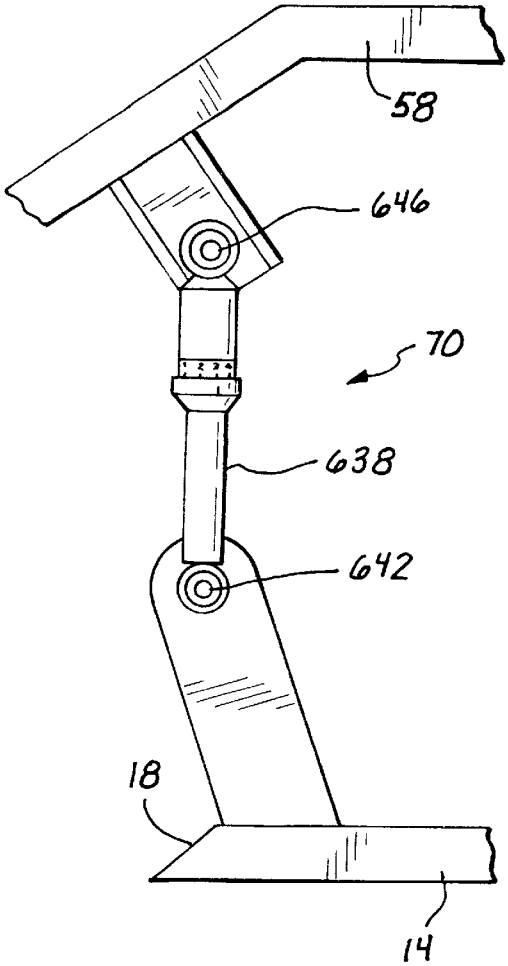
FIG. 6*b* is an enlarged side elevational detail of a shock absorber-type tensioning mechanism.

In still another variant of the invention, illustrated by FIG. 6*b,* the resistance device 70 further includes at least one adjustable shock absorber 638 that has a first end 642 and a second end 646. The shock absorber 638 is removably attached at its first end 642 to the base 14 adjacent its forward end 18 and is removably attached at its second end 646 to the body support platform 58 adjacent its forward end 62.

Figure 6C:
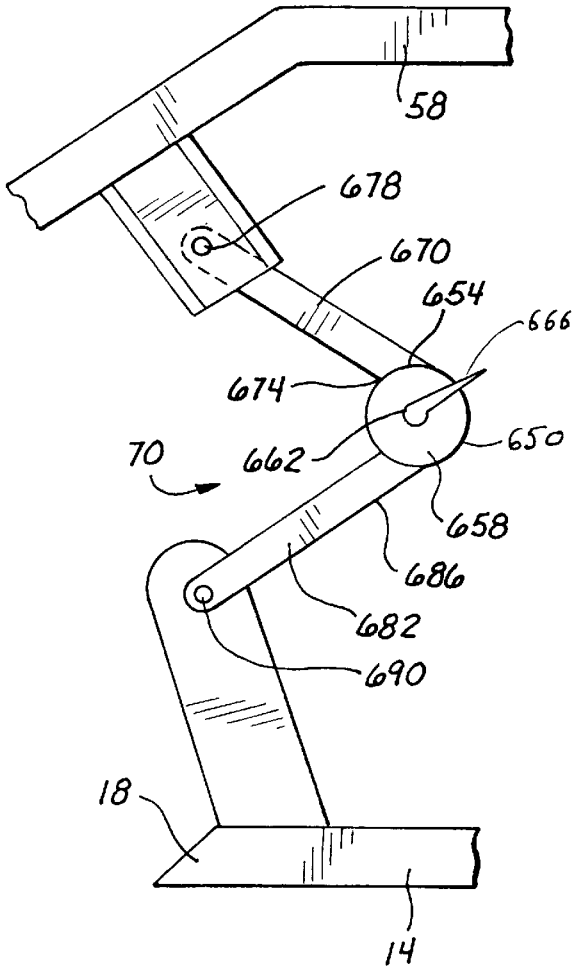
FIG. 6*c* is an enlarged side elevational detail of a friction clutch-type tensioning mechanism.

In yet a further variant, as illustrated by FIG. 6*c* the resistance device 70 further includes an adjustable friction clutch assembly 650. The clutch assembly 650 includes a driven plate member 654, a friction disk member 658, means 662 for rotatably mounting the friction disk member 658 to the driven plate member 654 and a means 666 for tightening the disk member 658 against the driven plate member 654. A first mounting arm 670 is provided that has a first end 674, a second end 678 and is fixedly attached at its first end 674 to the driven plate member 654 and removably attached at its second end 678 to the body support platform 58 adjacent its forward end 62. A second mounting arm 682 is provided that has a first end 686, a second end 690 and is fixedly attached at its first end 686 to the friction disk member 658 and removably attached at its second end 690 to the base 14 adjacent its forward end 18. When the disk member 658 is tightened against the driven plate member 654 using the means 666 for the tightening, the effort to operate the exercise machine 10 will be increased.

Figure 7:
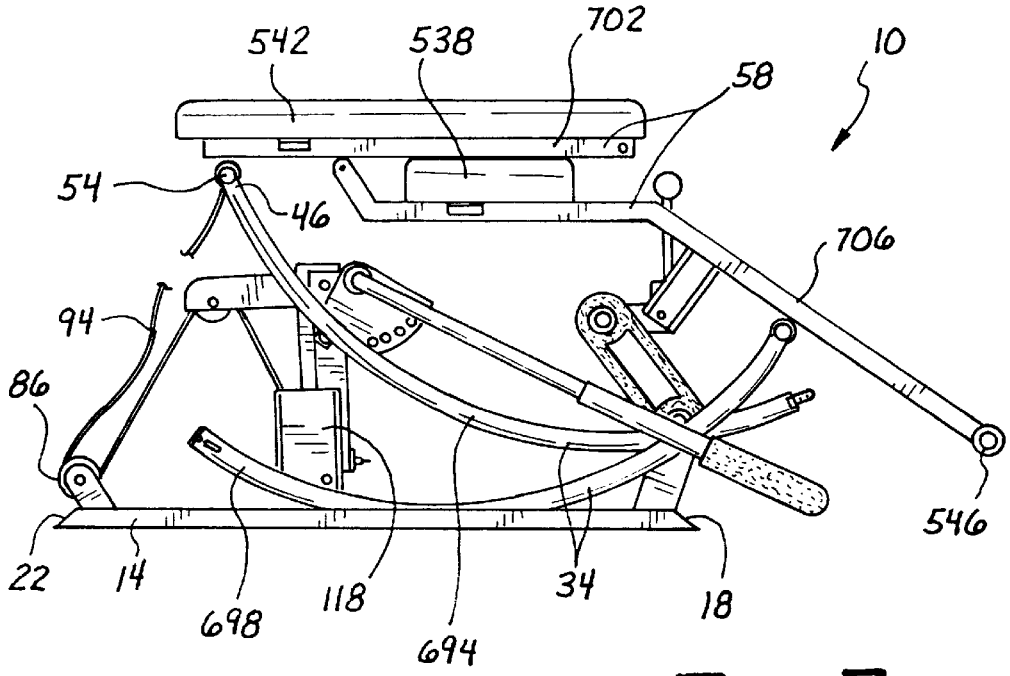
FIG. 7 is a side elevational view of the invention illustrating collapsible features for the support bars and body support platform.
Figure 8:
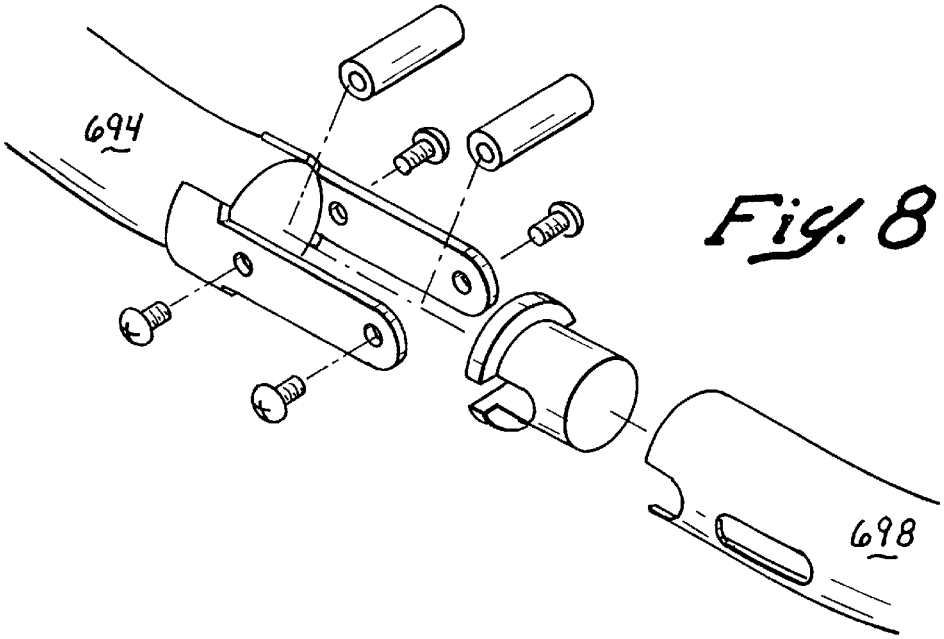
FIG. 8 is a perspective detail illustrating the means of joining the separable portions of the support bars.

In a final variant of the invention, as illustrated in FIGS. 7 and 8, the first 34 and second 38 parallel support bars are each formed of two removably joinable portions 694, 698, the rear connecting bar 54 is readily detachable from the support bars 34, 38 at their after ends 46, and the body support platform 58 is formed of two removably joinable portions 702, 706, thereby facilitating transport and storage of the machine 10.

The exercise machine 10 has been described with reference to particular embodiments. Other modifications and enhancements can be made without departing from the spirit and scope of the claims that follow.

What is claimed is:

1. An exercise machine, comprising:

a base, said base having a forward end and an after end and including first and second receiving means, said receiving means disposed between said forward end and said after end;

first and second parallel support bars, each of said support bars having a forward end and an after end and being sized, shaped, and disposed to fit slidably within one of said first and second receiving means, respectively;

front and rear connecting bars;

said front connecting bar joining said first and second support bars at their forward ends;

said rear connecting bar joining said first and second support bars at their after ends;

a body support platform, said platform having a forward end and an after end, and being fixedly attached at its forward end to the front connecting bar and being fixedly attached at its after end to the rear connecting bar;

a resistance device, said resistance device having an upper end and a lower end and being removably attached at its upper end adjacent the forward end of the body support platform and being removably attached at its lower end adjacent the forward end of the base;

a first pulley, said first pulley being fixedly attached adjacent the after end of the base;

a cable tightening means, said tightening means being fixedly attached to the first and second parallel support bars;

a cable, said cable having a first end and a second end and being fixedly attached at its first end to the rear connecting bar, passing through the first pulley, and being fixedly attached at its second end to the cable tightening means; and whereby, when the cable tightening means is operated by a user in either of a first and a second direction, the after end of the body support platform is urged toward the base against the resistance device and the weight of the user.

2. An exercise machine as described in claim 1, wherein the cable tightening means further comprises:

first and second mounting blocks, each of said first and second blocks having an inner side, an outer side, a lower surface, a circular orifice of a first internal diameter and a stop lug fixedly attached to said inner side and being spaced from said orifice;

each of said first and second mounting blocks being fixedly attached at its lower surface to one of said first and second support bars, respectively, such that the orifice of the first mounting block is collinear with the orifice of the second mounting block, the inner side of the first block is parallel to the inner side of the second block, and the stop lug of the first block is disposed facing the stop lug of the second block;

a first rigid, tubular shaft, said first tubular shaft having a first end, a second end, an internal bearing having the first internal diameter, a first predetermined length and being sized, shaped and disposed to fit slidably between said first and second mounting blocks;

a first bearing shaft, said first shaft having a first end and a second end and being sized, shaped, and disposed to fit slidably within the internal bearing of the first tubular shaft and to extend through the orifices of the first and second mounting blocks;

means for securing the first bearing shaft between the first and second mounting blocks;

first and second travel-limiting arms, each of said first and second arms having a first end and a second end and being fixedly attached at its first end adjacent one of the first and second ends of the first tubular shaft such that a long axis of each of the arms is perpendicular to a long axis of the first tubular shaft;

each of said first and second travel-limiting arms being sized, shaped and disposed to limit a rotation of the first tubular shaft about the bearing shaft by engaging one of the first and second stop lugs adjacent one of the second ends of the travel-limiting arms;

a hollow support column, said column having an upper end, a lower end, a front surface, a rear surface, a first side, a second side and being fixedly attached at its lower end perpendicular to the first tubular shaft between its first end and its second end;

said support column including a hollow, pulley support arm, said support arm having a first end and a second end and being fixedly attached at its first end perpendicular to the rear surface of the support column adjacent its upper end;

a second pulley, said second pulley being rotatably mounted adjacent the second end of the pulley support arm;

said support column including a first opening and a second opening, said first opening penetrating one of the front and rear surfaces of the column adjacent its lower end and being sized, shaped and disposed to permit passage of the cable, said second opening penetrating one of the front and rear surfaces of the column adjacent its lower end and being sized, shaped and disposed to permit the introduction of a third pulley;

said third pulley being rotatably mounted within the support column between the first and second openings thereof;

a second rigid, tubular shaft, said second tubular shaft having a first end, a second end, a second internal bearing having a second internal diameter, and a second predetermined length less than the first predetermined length and being fixedly attached perpendicular to the support column adjacent its upper end and parallel to the first tubular shaft;

a tensioning frame, said tensioning frame including first and second parallel side members, a lower cross member, first and second parallel offset members and a hollow actuating bar;

each of said side members having an upper end, a lower end, an inner side, an outer side and a circular orifice of the second internal diameter disposed adjacent its upper end, said orifices being collinear;

said side members being spaced apart by the second predetermined length;

said cross member being fixedly attached to each of said side members adjacent its lower end and having an anchoring means disposed between said side members;

a second bearing shaft, said second shaft having a first end and a second end and being sized, shaped, and disposed to fit slidably within the internal bearing of the second tubular shaft and to extend through the orifices of the first and second side members;

means for securing the second bearing shaft between the first and second side members;

said first and second offset members each having a first end and a second end, said second end including a circular orifice sized to rotatably accommodate said actuating bar, and being fixedly attached at its first end to one of the outer sides of one of the first and second side members adjacent its upper end;

said actuating bar having a first end, a second end and being rotatably mounted within the orifices of the first and second offset members;

means for removably securing the actuating bar to one of the first and second side members of the tensioning frame;

means for applying a twisting force to the actuating bar; and whereby, when the cable is fixedly attached at its first end to the rear connecting bar, passing under the first pulley, over the second pulley, under the third pulley, and is fixedly attached to the anchoring means of the lower cross member of the tensioning frame, the actuating bar may be twisted in either one of a clockwise and anti-clockwise direction to cause the cable to be tightened and thereby urging the after end of the body support platform toward the after end of the base against the resistance device and the weight of the user.

3. An exercise machine as described in claim 2, wherein the actuating bar, first and second side members and the means for removably securing the actuating bar to one of the first and second side members of the tensioning frame further comprise:

a locating plate, said locating plate having a first side, a second side, a mounting portion, a distal edge and being fixedly attached at the mounting portion adjacent one of the first and second ends of the actuating bar such that the first and second sides of the plate are orthogonal to a long axis of the bar;

said locating plate having at least one alignment hole of a third predetermined diameter and extending from the first side to the second side of said plate, said hole disposed adjacent the distal edge at a third predetermined distance from the long axis of the bar;

a securing hole, said securing hole being of the third predetermined diameter and penetrating the outer side of one of the first and second side members at the third predetermined distance from the long axis of the bar;

a spring-loaded pin assembly, said pin assembly including a hollow pin housing, a pin, a means for retracting the pin and a spring urging the pin outwardly from the housing, said pin being sized and shaped to slidably engage the alignment hole in the locating plate and the securing hole in one of the first and second side members;

a mounting bracket, said bracket being fixedly attached to one of the first and second side members and the hollow pin housing and being sized, shaped and disposed to position the pin to engage the securing hole and the alignment hole, said bracket being spaced from one of the first and second side members to permit the locating plate to fit slidably between the hollow pin housing and one of the first and second side members; and whereby, when the pin is urged toward the locating plate by the spring and passes through the alignment hole and into the securing hole in one of the first and second side members, the actuating bar will be removably secured to one of the first and second side members and thus the tensioning frame, thereby permitting twisting force to be applied through the actuating bar to the tensioning frame to tighten the cable and urge the body support platform toward the after end of the base against the resistance device and the weight of the user.

4. An exercise machine as described in claim 2, wherein the cable tightening means further comprises:

first and second operating handles; and means for removably attaching said first and second operating handles to one of the first and second ends of the actuating bar.

5. An exercise machine as described in claim 4, wherein means for removably attaching said first and second operating handles to one of the first and second ends of the actuating bar further includes:

at least two locating notches, said notches disposed at the first and second ends of the actuating bar, said actuating bar having a long axis;

at least two first locking holes, said first holes being spaced inwardly from the first and second ends of the actuating bar and penetrating said bar perpendicular to its long axis;

said first and second operating handles having a first end, a first portion adjacent said first end, a second end, a second portion adjacent said second end, said second portion extending from said first portion at a right angle;

said operating handles being formed of rigid cylindrical material and being sized and shaped to allow said first end to fit slidably within the hollow actuating bar;

at least two first locking buttons, said first buttons being disposed adjacent the first end of the first and second operating handles and being sized and shaped to removably engage the first locking holes in the actuating bar; and at least two locating lugs, said lugs being disposed adjacent the first end of the first and second operating handles and being sized and shaped to removably engage the locating notches disposed at the first and second ends of the actuating bar when the first locking buttons engage the first locking holes.

6. An exercise machine as described in claim 5, wherein the first and second operating handles further include:

at least two second locking buttons, said second buttons disposed adjacent the second end of the first and second operating handles;

first and second handle extensions, said extensions having a first end, a first section adjacent said first end, a second end, a second section adjacent said second end, said second section extending from said first section at a right angle;

said handle extensions being formed of hollow rigid cylindrical material and being sized and shaped to allow the second ends of the first and second operating handles to fit slidably within the first section of the handle extensions; and said first section including a plurality of second locking holes, said second locking holes being spaced from the first ends of the first and second handle extensions and being sized and shaped to removably engage the second locking buttons of the first and second operating handles, thereby removably securing the first and second handle extensions to the second ends of the first and second operating handles in at least one position.

7. An exercise machine as described in claim 6, wherein the first and second handle extensions further include a resilient padding material disposed upon the second section of the handle extensions.

8. An exercise machine as described in claim 1, wherein the body support platform further includes a seat member, a back support member and a foot support member.

9. An exercise machine as described in claim 1, wherein the resistance device further includes:

at least one resilient member, said member having a first end and a second end;

a lower mounting bracket, said lower bracket having a first end, a second end and being fixedly attached at its first end to the base adjacent its forward end;

said lower mounting bracket including means for removably attaching the lower bracket to the first end of the resilient member, said means disposed adjacent the second end of said lower bracket;

an upper mounting bracket, said upper bracket having an upper end, a lower end and being fixedly attached at its upper end to the body support platform; and means for removably and adjustably attaching the second end of the resilient member to the lower end of the upper mounting bracket.

10. An exercise machine as described in claim 9, wherein the means for removably and adjustably attaching the second end of the resilient member to the lower end of the upper mounting bracket further includes:

an offset bar, said offset bar having a first end, a second end, a top surface and having a means fixedly attached adjacent its first end for removably attaching to the second end of the resilient member and being pivotally mounted adjacent its second end to the lower end of the upper mounting bracket;

an actuating handle, said actuating handle having a first end, an elongated body, a second end and being mounted to the top surface of the offset bar adjacent its second end;

a plurality of adjusting notches, said adjusting notches being affixed to the body support platform adjacent the upper mounting bracket and being sized, shaped, and disposed to removably engage the elongated body of the actuating handle; and whereby, when the actuating handle is pivoted in a first direction it will be disengaged from one of the adjusting notches and when the actuating handle is pressed toward the forward end of the base, the offset bar will pivot at the lower end of the upper mounting bracket and thereby impart tension to the resilient member, and when the elongated body is aligned with another adjusting notch and the actuating handle is pivoted in a second direction the elongated body will engage said notch and the resilient member will retain the imparted tension and the actuating handle may be released, thereby increasing the effort required to operate the exercise machine.

11. An exercise machine as described in claim 1, wherein the resistance device further includes:

at least one adjustable shock absorber, said shock absorber having a first end and a second end; and said shock absorber being removably attached at its first end to the base adjacent its forward end and being removably attached at its second end to the body support platform adjacent its forward end.

12. An exercise machine as described in claim 1, wherein the resistance device further includes:

an adjustable friction clutch assembly, said clutch assembly including a driven plate member, a friction disk member, means for rotatably mounting the friction disk member to the driven plate member and a means for tightening the disk member against the driven plate member;

a first mounting arm, said first arm having a first end, a second end and being fixedly attached at its first end to the driven plate member and being removably attached at its second end to the body support platform adjacent its forward end;

a second mounting arm, said second arm having a first end, a second end and being fixedly attached at its first end to the friction disk member and being removably attached at its second end to the base adjacent its forward end; and whereby, when the disk member is tightened against the driven plate member using the means for said tightening, the effort to operate the exercise machine will be increased.

13. An exercise machine as described in claim 1, wherein the first and second parallel support bars are each formed of two removably joinable portions, the rear connecting bar is readily detachable from said support bars at after their ends, and the body support platform is formed of two removably joinable portions, thereby facilitating transport and storage of the machine.

* * * * *